US005471924A

United States Patent [19]

Helling

[11] Patent Number: 5,471,924

[45] Date of Patent: Dec. 5, 1995

[54] METHOD AND APPARATUS FOR DRYING AN OBJECT DURING TRANSPORTATION

[75] Inventor: Ralf Helling, Melle, Germany

[73] Assignee: Werner Kammann Maschinenfabrik GmbH, Germany

[21] Appl. No.: 278,732

[22] Filed: Jul. 22, 1994

Related U.S. Application Data

[63] Continuation-in-part of Ser. No. 104,313, Aug. 10, 1993, abandoned.

[30] Foreign Application Priority Data

Aug. 25, 1992 [DE] Germany ..... 42 28 142.3

[51] Int. Cl.[6] ..... B41F 15/12; B41F 15/30

[52] U.S. Cl. ..... 101/38.1; 101/40.1; 101/124; 101/129; 101/424.1

[58] Field of Search ..... 101/37, 38.1, 39, 101/40, 40.1, 123, 124, 129, 424.1, 487, 488; 34/105, 275, 276, 277, 278

[56] References Cited

U.S. PATENT DOCUMENTS

| | | | |
|---|---|---|---|
| 3,071,868 | 1/1963 | Kalman | 34/105 |
| 3,752,070 | 8/1973 | Jaffa | 101/123 |
| 4,048,914 | 9/1977 | Kammann et al. | 101/40 |
| 4,408,400 | 10/1983 | Colapinto | 34/4 |
| 4,517,893 | 5/1985 | Wile et al. | 101/123 |
| 4,671,174 | 6/1987 | Tartaglia et al. | 101/123 |
| 4,813,351 | 3/1989 | Pierson, Jr. | 101/129 |
| 5,142,975 | 9/1992 | Podalsky et al. | 101/40.1 |
| 5,207,156 | 5/1993 | Helling | 101/38.1 |

FOREIGN PATENT DOCUMENTS

| | | |
|---|---|---|
| 807202 | 4/1951 | Germany . |
| 3118855 | 5/1982 | Germany . |
| 3936157 | 5/1991 | Germany . |
| WO-A-8702623 | 7/1987 | WIPO . |

*Primary Examiner*—Stephen Funk
*Attorney, Agent, or Firm*—Seidel, Gonda, Lavorgna & Monaco

[57] ABSTRACT

In a method and apparatus for printing on objects using a screen printing procedure, the print image applied to a respective object is dried by UV-rays produced by at least one UV-radiating device. Drying of the applied print image is effected during a transportation movement which the object performs in order to be transported after the drying operation from one location to another. The radiating device which produces the UV-rays is moved with the object at least during a pert of the transportation movement in the direction of movement of the object, in such a way that in such movement the print image is dried.

23 Claims, 8 Drawing Sheets

METHOD AND APPARATUS FOR DRYING AN OBJECT DURING TRANSPORTATION

CROSS REFERENCE TO RELATED APPLICATION

This is a continuation-in-part of application Ser. No. 08/104,313, filed Aug. 10, 1993, now abandoned.

BACKGROUND OF THE INVENTION

When printing on objects or articles such as bottles or similar containers, glasses or the like, in many cases, in order to achieve a sufficiently high level of productivity, it is necessary for the operation of applying printing ink or dye or like material, which is referred to hereinafter as printing ink, to the object to be followed by a special drying operation for drying the printing ink as otherwise, that is to say without such a special drying operation, it would take too long for the printing ink to dry to such a degree that the object could be handled without giving rise to the risk of smearing or smudging the previously applied print image. The necessity for rapid drying for the purposes of increasing productivity arises more particularly in connection for example with further transportation movement of such an object, in the course of which the surface of the object which has been provided with a print image may cane into contact with some other surfaces so that the previously applied image can be adversely affected as a result. However, it should be noted that the need for drying printing ink as quickly as possible, after a printing operation has been carried out, to such a degree that the applied printing ink adheres firmly to the object and is also not smeared or smudged upon coming into contact with other surfaces also arises when a plurality of print images are successively applied to the object, in order for example to produce a composite multi-color print image. When using a screen printing procedure, the mode of operation adopted in that situation is that a partial print image is applied for example in a given color, in a printing operation using a screen printing stencil and an associated doctor or squeegee, and thereafter, in succession, further partial print images are applied for example using different colors. When a following partial print image is applied in such a procedure, the previously applied partial print image must already be dry in order to ensure that it is not smeared or smudged in subsequent printing operations.

Practical operating situations predominantly involve using printing lacquers and printing inks which polymerize or set due to the effect of UV-rays, and become dry as a result. That drying procedure has proven to be satisfactorily viable in a practical context, in particular also for the reason that, when suitable levels of radiation intensity are chosen, which are familiar to any man skilled in the art, the drying operation can be effectively carried out within a few seconds. Drying printing inks by means of UV-radiation is employed in particular in relation to objects of plastic material such as bottles consisting of polyethylene or polyethylene terephthalate, but it is also employed in relation to objects of other materials such as glass or porcelain.

In general terms the arrangement is such that the drying assembly which has a UV-radiating device is disposed in the screen printing machine and is therefore pan thereof. Normally a screen printing machine has two or more treatment stations for the objects to be printed upon. The operation of printing on the objects is effected in one of those stations and then disposed downstream of the printing station in the object transportation direction is a drying station in which the printing ink which is applied in the previous printing station is then dried by UV-rays.

Usually the design configuration in such machines is such that each station has at least one holding means which carries the object while it is in that station. Those holding means may also be arranged displaceably between for example two adjacent stations so that they can additionally be used for stepwise transportation movement of the objects in the machine. It is however also possible to provide at least one particular transportation device for transporting the objects from one station to the respective following station. Another possible design configuration is one in which a part of the object transportation movement is effected by means of the displaceable holding means while another part of the object transportation movement is effected by a particular transportation means.

The holding means are frequently so arranged that they permit a rotary movement of the objects about their longitudinal axis or about an axis parallel thereto, during the respective treatment operation. The treatment devices are generally associated with the respective treatment station and are movable only insofar as is required for carrying out the treatment operation in that station.

The drying station or stations in known machines are also disposed stationarily, with the result that, in addition to the time that the object must spend in the treatment station for the drying treatment to be performed, there is also the time required for the object to be transported from a station which is disposed upstream of the drying station in the object transportation direction, into the drying station itself. In other words, a considerable amount of time is required overall for carrying out the drying operation. In that respect, the following point should also be noted: the per se known drying of lacquers and inks by virtue of the action of UV-rays presupposes that the lacquers and inks used harden or polymerize under the effect of UV-rays. The changes or reactions which cause such hardening or polymerization, in the ink or lacquer, require in any case a certain minimum period of time. In that respect, the situation can arise where that minimum time is longer than the time required in the printing station for applying a print image to the object therein. In such cases, the maximum capacity of the printing stations is not utilized as the residence time of the objects in the individual stations will thus depend on the duration of the drying operation, and thus the beginning of the next following printing operation is not determined by the end of the preceding printing operation, but by the duration of the drying operation for the object to which printing was applied in the preceding working cycle.

The time taken for a working cycle in a printing machine is generally composed of the transportation time for the objects and the stoppage time during which the objects are being treated in the treatment stations. In many machines, in the normal course of a working cycle, the transportation time makes up a greater proportion of the working cycle than the stoppage time.

SUMMARY OF THE INVENTION

An object of the present invention is to provide a method of printing on and drying an object, which enjoys an increased level of productivity.

Another object of the present invention is to provide a method of applying printing to and drying the printing on an object, in which the residence time of an object in the operating procedure is reduced without the quality of the finished product suffering from any adverse effects.

Still another object of the present invention is to provide a method of applying printing to an object and drying same which is improved without involving at least major complication.

Yet another object of the present invention is to provide an apparatus for printing on an object and drying the printing, which while being of simple structure affords an increased level of productivity by reducing the residence time of the object without adverse effects in terms of quality of the finished product.

A further object of the present invention is to provide an apparatus for printing on and drying an object which affords an increased level of productivity without entailing major complication and without a significant increase in cost.

In accordance with the present invention, in regard to the method, the foregoing and other objects are achieved by a method of applying printing to and drying each object, using a screen printing procedure, wherein at least one print image is applied to the object in at least one printing station of a screen printing apparatus using at least one screen printing stencil and a doctor co-operating therewith, whereupon the print image on the object is dried by UV-rays produced by at least one UV-radiating device. The operation of drying the applied print image is effected during a transportation movement which the object performs in order to be transported after the printing operation from one location to another. The at least one UV-radiating device is moved with the object during at least a part of the transportation movement performed by the object, in the direction of movement thereof, in such a way that at least a part of the object is in the region of action of the UV-rays.

In accordance with the present invention, in the apparatus aspect, the foregoing and other objects are attained by an apparatus for printing on an object, including at least one screen printing stencil and a doctor co-operable therewith. At least one transportation device transports the object through at least a portion of the apparatus, and the apparatus further includes an arrangement having at least one UV-radiating device for drying at least one print image applied to the object by the screen printing stencil and the doctor. The UV-radiating device is disposed movably in such a way that, during a transportation movement of the object provided with at least one said print image, the UV-radiating device is movable in the direction of movement of the object such that, during the transportation movement of the object, at least the part thereof which bears the applied print image is disposed in the region of action of the UV-radiating device.

Advantageously the arrangement is such that the UV-radiating device is disposed above a said object to be irradiated. It will be appreciated that the result of that is that the rays only act on the upwardly facing region of the object or the print image thereon. However that does not give rise to disadvantages as, during the drying operation, the object can be easily rotated about its longitudinal axis or an axis which is at least substantially parallel thereto so that, even if the print image extends over a considerable peripheral distance and possibly even over a distance of 360°, the entire region of the print image can be exposed to the UV-rays by virtue of the rotary movement of the object.

In general, the procedure will preferably be such that the object and the UV-radiating device are moved synchronously during the drying operation. For reasons relating to the machine design configuration it will be desirable for the UV-radiating device which is disposed in the usual manner within a housing in order to avoid adverse effects on the area therearound and to prevent damage to the health of operating personnel by virtue of exposure to UV-rays, to be movable along a linear path. That also applies to the object, although it is possible for the object to be moved along a curved path during the drying operation. In that case a synchronous movement between the object and the UV-radiating device would mean that the component of movement of the object parallel to the path of movement of the UV-radiating device is matched to the movement of the latter.

Further objects, features and advantages of the present invention will be apparent from the following description of preferred embodiments.

DESCRIPTION OF THE PREFERRED EMBODIMENTS

Figure 1:
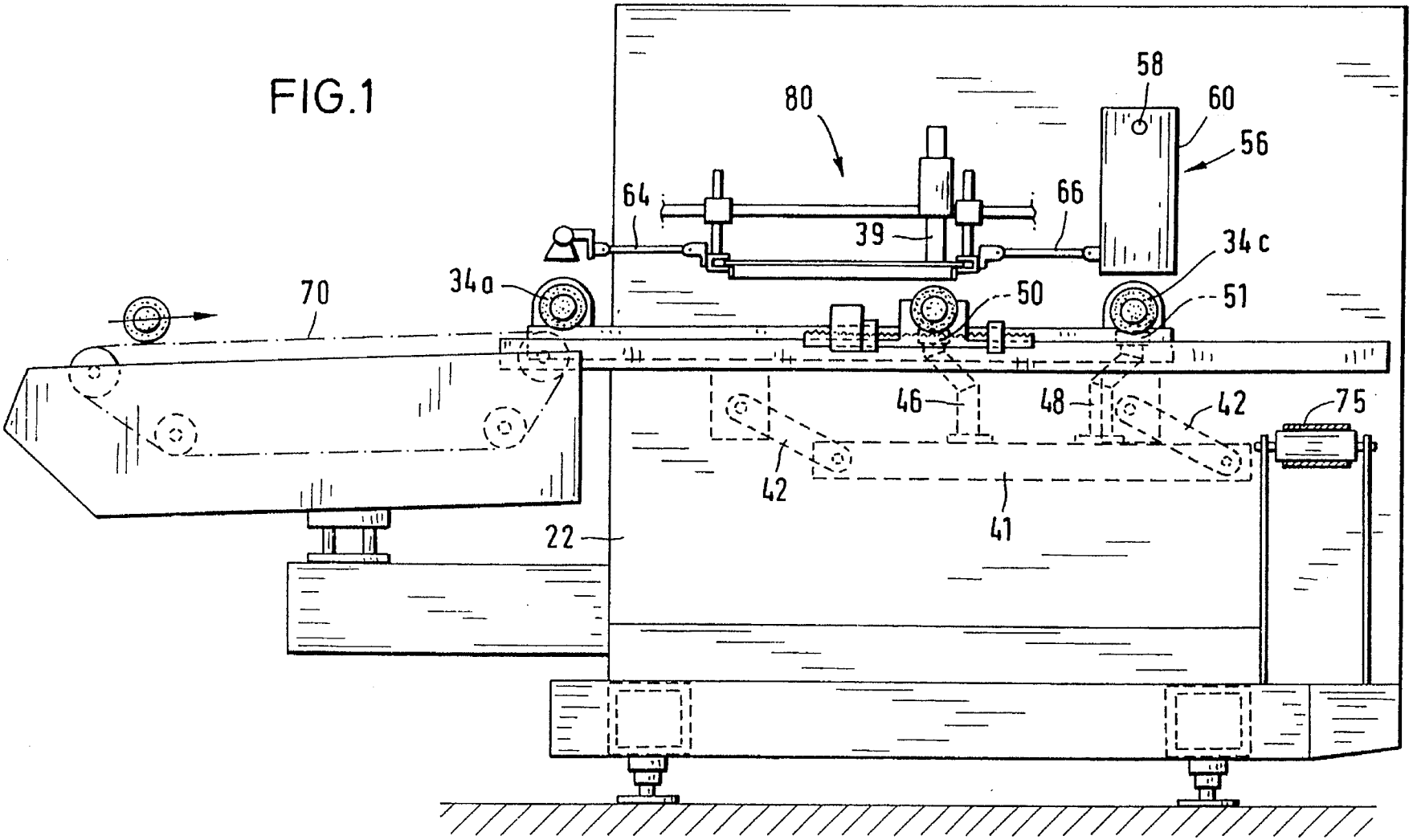
FIGS. 1 through 3 show side views of a screen printing machine in three successive working phases.
Figure 2:
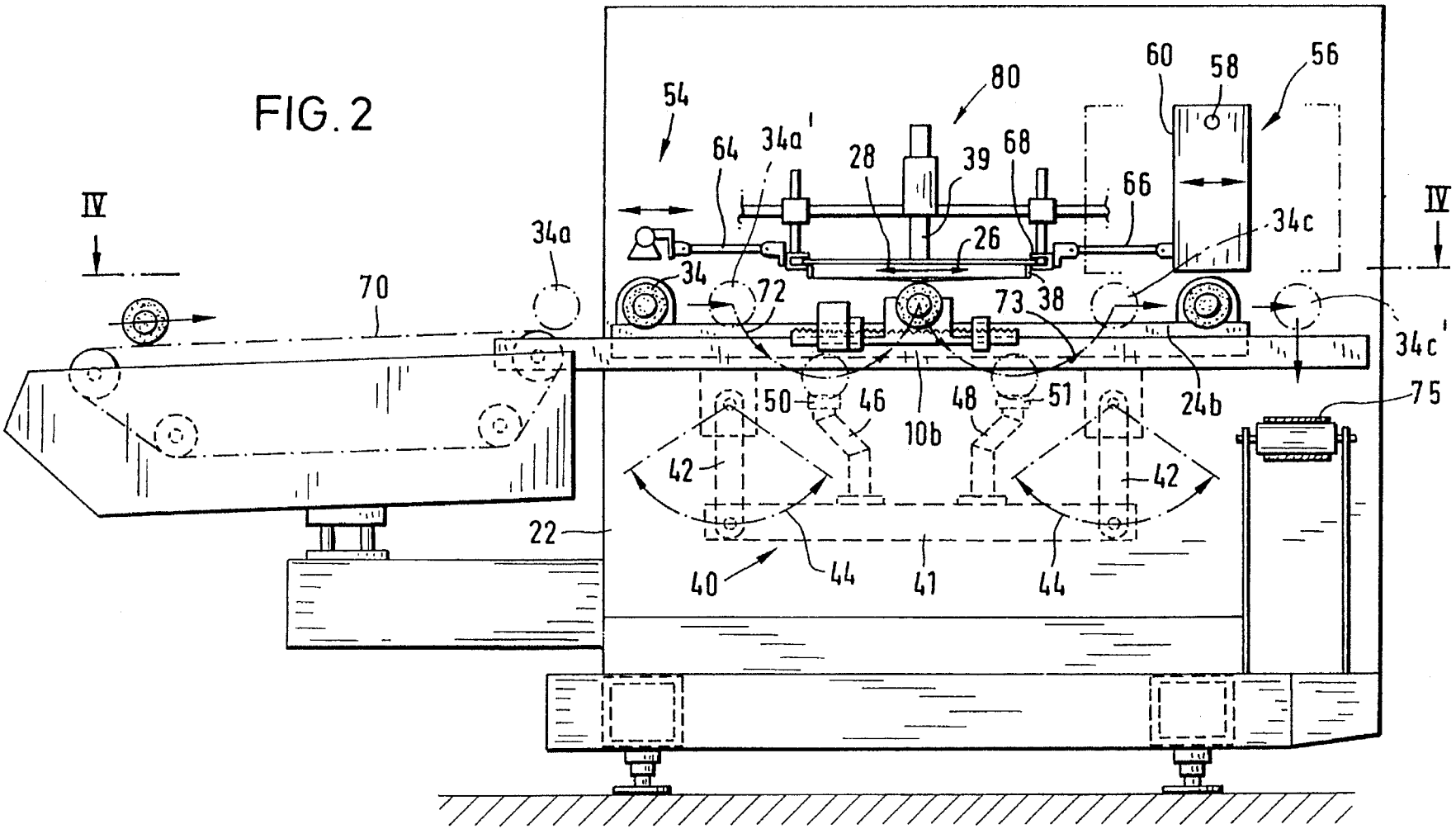
Figure 3:
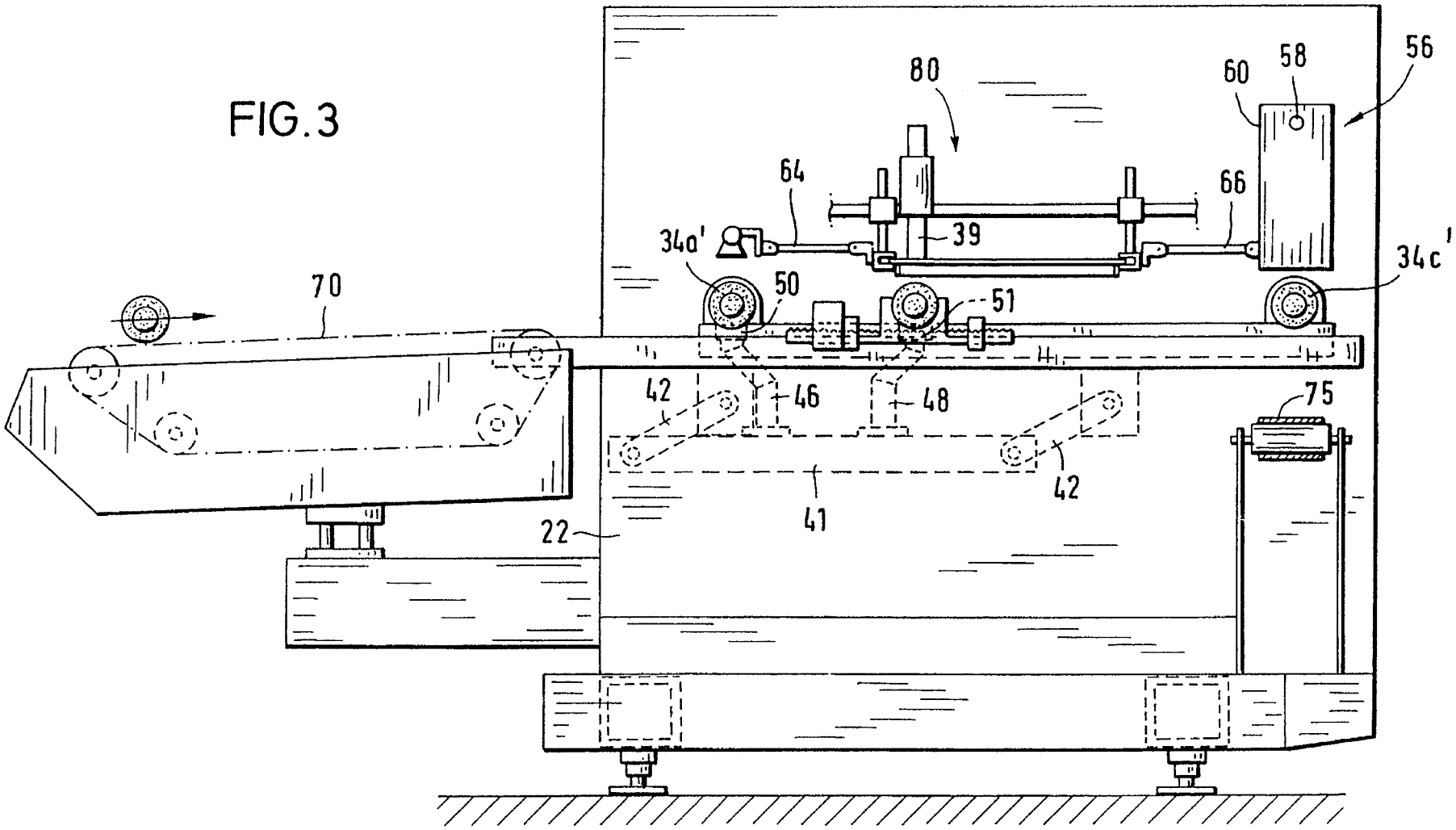
Figure 4:
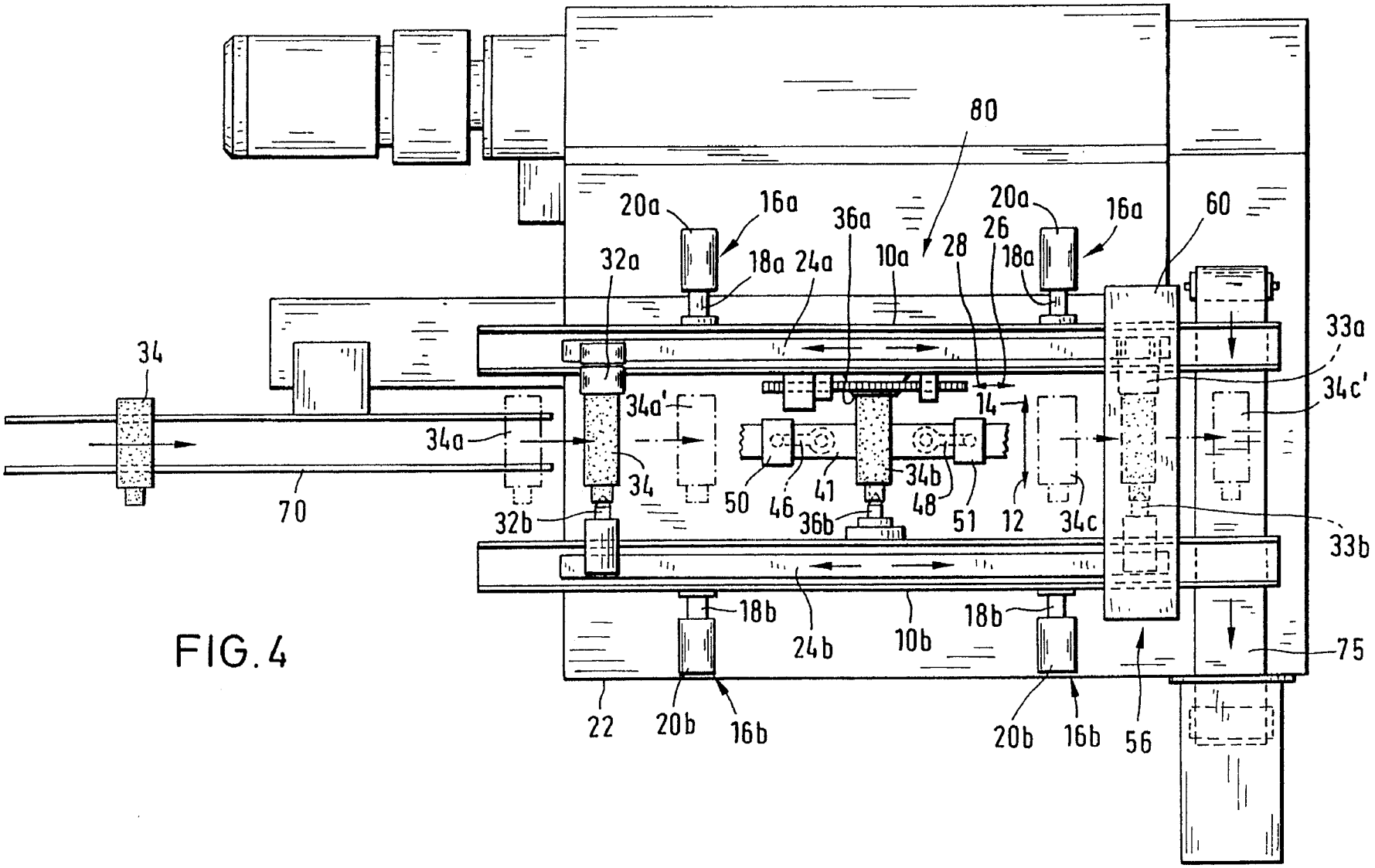
FIG. 4 is a plan view of the machine in the phase in FIG. 2.

Referring firstly to FIGS. 1 through 4 showing a first embodiment of the present invention, shown therein is an embodiment of the apparatus according to the invention, which is provided with two upwardly open U-shaped rails indicated at 10*a* and 10*b* in FIG. 4 and of which one is indicated at 10*b* in FIG. 2. The rails 10 and 10*b* extend parallel to each other and are arranged displaceably relative to each other in the direction indicated by the arrows 12 and 14 in FIG. 4 between two limit positions, of which FIGS. 2 and 4 show the limit position in which the two rails 10*a* and 10*b* are at the smallest spacing from each other. The movements of the rails in the direction indicated by the arrows 12 and 14 are produced by drive means 16*a* and 16*b* in the form of piston-cylinder units. The piston-cylinder units have piston rods 18*a* and 18*b* which are each connected to a respective rail 10*a* and 10*b*. The cylinders 20*a* and 20*b* are mounted to the frame structure 22 of the apparatus. It is however also possible to use other, for example mechanical drive means for displacing the two rails 10*a* and 10*b*.

Holder carriers 24*a* and 24*b* which form a transportation device and are also of a rail-like configuration are mounted within respective ones of the two U-shaped rails 10*a* and 10*b* reciprocally in the directions indicated by the arrows 26 and 28 in FIG. 4. The two carriers 24*a* and 24*b* are connected to drive means which are not shown in the drawing for the sake of enhanced clarity thereof and which produce the reciprocating movements of the carriers 24*a* and 24*b* in the direction of the arrows 26 and 28.

Mounted to the the carriers 24*a* and 24*b* are holder members indicated at 32*a*, 32*b* and 33*a*, 33*b* in FIG. 4, for holding respective ones of the objects or articles 34 which are to be treated in the apparatus and which in this embodiment are in one form of bottles. It can be seen from FIG. 4 that the holder members 32*a*, 32*b* and 33*a*, 33*b* are disposed in respective pairs in such a way that the holder members of each pair are disposed in mutually opposite relationship. In that respect the holder members are adapted to the configuration of the respective object to be handled, in the usual fashion. The holder members 32*a* and 33*a* which receive the bottom end of the respective bottle 34 are each provided for that purpose with a recess to form a receiving seat. The holder members 32*b* and 33*b* on the other hand are of a mandrel-like configuration so that they can fit into the neck opening of the respective bottle to be held by a pair of holder members 32*a*, 32*b* and 33*a*, 33*b*. As the holder members 32*a*, 32*b*; 33*a*, 33*b* are mounted on the carriers 24*a* and 24*b* respectively, they participate both in the reciprocating movements of the latter in the direction of the arrows 26 and 28, and also in the reciprocating movements perpendicular thereto in the direction of the arrows 12 and 14, produced by the motion of the rails 10*a* and 10*b*.

A further pair of holder members 36*a*, 36*b* in FIG. 4 is arranged approximately in the center of the two rails 10*a* and 10*b* on the latter. The two holder members 36*a* and 36*b* can be mounted on the respectively associated rails 10*a* and 10*b* with the interposition of means such as to permit a pivotal movement of the holder members, for example as are described in U.S. Pat. No. 5,307,156 in connection with printing on objects of elliptical cross-section. It will be noted however that the particular configuration of the objects is immaterial from the point of view of the present invention. It is therefore entirely possible for the invention to be used for printing on objects of cylindrical cross-section, as are shown in the drawing. When printing on cylindrical objects, there is no need for the holder members 36*a* and 36*b* to perform a pivotal movement. There is no need here to discuss the respective requirements, from the point of view of printing procedure, which have to be observed in dependence on the shape of the object, as such requirements are familiar considerations in this context.

Irrespective of the arrangement of the holder members 36*a* and 36*b*, the holder members 32*a*, 32*b* and 33*a*, 33*b* are so mounted that they permit the object held thereby to rotate about its longitudinal axis or about an axis which is at least substantially parallel thereto. That is generally achieved by the holster members being suitably rotatably mounted on the carriers 24*a* and 24*b*.

The holder members 36*a* and 36*b* are associated with the printing station 80 of which the embodiment illustrated in FIGS. 1–4 has only one although, as will be appreciated, the apparatus may comprise a plurality of printing stations. The illustrated printing station has a screen printing stencil which is carried by the usual frame structure as indicated at 38 in FIG. 2, and a doctor or squeegee 39 co-operating therewith. The screen frame 38 is carried by a screen slider or carriage as indicated at 68 in FIG. 2, which is provided with a drive means (not shown) for producing reciprocating movement of the screen printing stencil in the usual fashion in the direction of the arrows 26 and 28, in which case the printing ink is applied to the object to be decorated in one of the two directions of motion.

The embodiment of the apparatus illustrated in the drawing is further provided with a second transportation device as indicated at 40 in FIG. 2, which is arranged substantially below the two rails 10*a* and 10*b*. The transportation device 40 comprises a bearer 41 which is disposed to extend substantially parallel to the two rails 10*a* and 10*b*, being mounted on the machine frame structure 22 pivotably by way of two pivot arms 42. The bearer 41 which, as indicated by the arrows 44 in FIG. 2, can be pivoted to and fro in a vertical plane which is parallel to the rails 10*a* and 10*b*, is provided with two transportation holders 46 and 48, each of which is provided at its upper free end with a receiving means or mounting 50 and 51 respectively. The top surface which defines the configuration of the respective mountings 50 and 51 is adapted to the configuration of the object 34 to be transported. In order to ensure that, during the transportation movement, the object 34 remains in its correct position on the respective mounting 50 and 51, the latter, at their upward surfaces on which the object lies, are each provided with openings which can be connected to a reduced-pressure or vacuum source, so that a reduced pressure acts on the object with the result that the object is pressed against the mounting 50 or 51 and is thus securely held in position thereon. In regard to the specific design configuration of the transportation device 40 and its co-operation with the other components of the apparatus, attention is also directed to U.S. Pat. No. 5,207,156 in regard to the general disclosure thereof which is hereby incorporated into this specification by reference thereto.

The apparatus according to the invention is further provided with first and second treatment devices 54 and 56 for treating the objects. Of those treatment devices, the device 54 which is disposed upstream of the printing station which comprises the screen printing stencil and the doctor, in the direction of transportation movement as indicated at 28 of the bottle 34, serves for flame treatment of the surface of the bottles 34 to be printed upon, as is required in many cases when printing upon objects consisting of the thermoplastic material. The device 56 which is disposed downstream of the printing station in the transportation direction 26 essentially comprises a UV-radiating device 58 which is disposed within a housing 60 which downwardly is open or transmissive for UV-rays. Elsewhere, the housing 60 does not transmit UV-rays. Both the flame-treatment device 54 and also the drying device 56 are connected by way of coupling rods 64 and 66 respectively to the carriage 68 which carries the screen printing stencil frame 38 so that the two devices 54 and 56 are moved synchronously with the screen printing stencil. Both devices 54 and 56 can be guided on the machine frame structure although such guides are not shown in the drawing for the sake of clarity thereof.

The bottles which are supplied to the apparatus by way of a conveyor 70 disposed on the upstream side of the apparatus, when reaching the position 34*a*, are individually received by the pair of holder members 32*a* and 32*b*. For that purpose, the two carriers 24*a* and 24*b* are displaced within the respectively associated rails 10*a* and 10*b* into the left-hand limit position shown in FIG. 1, in which the two holder members 32*a* and 32*b* are aligned with the bottle which is in the position indicated at 34*a*. Upon being displaced into the left-hand limit position, the two rails 10*a* and 10*b* and therewith also the holder members are at their greatest spacing apart. The bottle is then engaged by the two holder members 32*a* and 32*b*. For that purpose, the rail 10*a* is moved in the direction indicated by the arrow 12 while the rail 10*b* is moved in the direction indicated by the arrow 14. At the same time, in the course of that movement, the holder members 36*a* and 36*b* engage a bottle which is disposed in the printing station and which is carried by the mounting 50 of the transportation device 40, and the holder members 33*a* and 33*b* engage a bottle which is disposed downstream of the printing station in the transportation direction 26 at position 34*c* and to which printing has already been applied and which is carried by the mounting 51. In the course of the subsequent axial displacement of the carriers 24*a* and 24*b* within the rails 10*a* and 10*b* towards the right into the position shown in FIG. 3, the bottle which is carried by the holder members 32*a* and 32*b* is transportal from position 34*a* into position 34*a'*. When that happens, the bottle which is carried by the two holder members 33*a* and 33*b* is transported from position 34*c* into position 34*c'*. At the same time, in the printing station, the bottle which is disposed therein, as indicated at the position 34*b*, receives its printing. The movement of the bottle which may be required for that purpose is effected independently of the displacement of the two bottles 34*a* and 34*c* as the holder members 36*a* and 36*b* which are associated with the printing station are not carried by the carriers 24*a* and 24*b*.

The movement of the two carriers 24*a* and 24*b* in the direction indicated by the arrow 26, into the position shown in FIG. 3, is however synchronized with the movement of the screen printing stencil and thus the carriage 68, in such a way that the fiche-treatment device 54 is displaced above the bottle 34*a* synchronously with that bottle from position 34*a* into position 34*a'* so that, during that transportation stepping movement, the bottle is subjected to the flame treatment. In addition, during the movement of the bottle carried by the two holder members 33*a* and 33*b* from position 34*c* into position 34*c'*, the drying device 56, by virtue of being connected by way of the coupling red 66 to the carriage 68, is also moved synchronously with the bottle held by the two holder members 33*a* and 33*b*, so that the printing ink which was previously applied to that bottle in the printing station dries during the transportation movement from 34*c* to 34*c'*. FIGS. 2 and 4 show the members in a position approximately in the middle of that transportation stepping movement.

At the latest at the end of the above-described transportation movement of the two carriers 24*a* and 24*b*, with the bottles carried thereby (see FIG. 3), the empty transportation device 40 is pivoted from the position shown in FIG. 1 into its left-hand limit position shown in FIG. 3, in which the mounting 50 of the transportation holder is disposed beneath the bottle which is in position 34*a'*, and bears against same, while the mounting 51 assumes a corresponding position relative to the bottle in the printing station at position 34*b*. Thus, the bottle held by the holding members 32*a* and 32*b* in position 34*a'* and the bottle held by the holding members 36*a* and 36*b* in the position 34*b* are released by virtue of the rails 10*a* and 10*b* moving away from each other, and are received by the mountings 50 and 51 respectively. There then follows a pivotal movement of the transportation device 40 into the other right-hand limit position shown in FIG. 1, in which the bottles carried by the two mountings 50 and 51 respectively follow the paths shown in dash-dotted lines at 72 and 73 in FIG. 2, with the result that, at the end of that movement, the bottle taken from the holding members 32*a* and 32*b* is now in the printing station for the next printing operation, while the bottle to which .printing was previously applied is in the starting position 34*c* for the drying transportation step. Immediately after the two rails 10*a* and 10*b* move away from each other, the two carriers 24*a* and 24*b* are moved again into their left-hand limit position so that, in the subsequent movement of the two rails 10*a* and 10*b* in the direction of the arrows 12 and 14, in such a way as to reduce their spacing from each other, the next bottle which in the meantime has arrived at the position 34*a* on the conveyor 70, the bottle which is disposed in the printing station and carried by the mounting 50, and the bottle which is disposed in the station 34*c* and carried by the mounting 51, are each taken over by the respectively associated holding members 32*a*, 32*b*; 36*a*, 36*b*; and 33*a*, 33*b*, whereupon, in the next transportation position from the left-hand limit position shown in FIG. 1 into the right-hand limit position shown in FIG. 3, the object which has just been taken from the conveyor 70 is again subjected to the flame treatment and the object to which printing was applied in the preceding working circle is dried.

The bottle in the position 34*c'*, which was released by the holding members 33*a*, 33*b* at the end of the drying step, by virtue of the two rails 10*a* and 10*b* moving away from each other, drops on to a transportation belt 75 which is disposed beneath the position 34*c'* and which transports the printed bottles out of the machine.

It will be appreciated that the treatment device 56 may also be provided with a plurality of radiating devices which for example are arranged one beside the other in the housing 60.

The return motion of the two treatment devices 54 and 56 into the starting position shown in FIG. 1 is also effected by virtue of being entrained by the carriage 68, by way of the two coupling rods 64 and 66, when the carriage 68 is moved in the direction indicated by the arrow 28.

It is however also possible to provide another and possibly additional drive for producing the movements of the treatment device or devices 54 and/or 56, if for example the movement of the device or devices 54 and/or 56 are to be produced independently of the movements of the screen printing stencil.

The holding members 32*a*, 32*b* and 33*a*, 33*b* are mounted rotatably on the respective carriers 24*a* and 24*b*, in such a way that the bottle carried by the respective pairs of holding members can be rotated about its longitudinal axis or an axis which is at least substantially parallel thereto. The drive for producing that rotary movement can be produced for example by the two holder members 32*a* and 33*a* being provided with a shaft which, on the outward side, that is to say, at the side of the holder member which is remote from the respective bottle, carries a gear meshing with a rack mounted stationarily on the frame structure of the screen printing apparatus. The rotary movement may be necessary if the bottle or other object is to be subjected to a flame treatment or is to be exposed to the effect of the UV-rays, over the entire periphery of the bottle or object. Depending on the output of the radiating device (in watts/cm) and the wavelength of the rays (in the nanometer range 200–400) and depending on the properties of the photo-initiators which react thereto in the printing ink, it may also be desirable or even necessary to effect a multiple irradiation procedure. The number of revolutions to be performed by the object for that purpose can be determined by the choice of diameter for example of the gear for driving the at least one holder member of each pair. Another possible design configuration in this respect involves the provision of an additional regulatable motor for producing the rotary movements of the bottle or object by driving the at least one holder member of each pair thereof.

By virtue of the displaceable arrangement of the UV-radiating device, it is possible to effect the operation of drying the object with printing applied thereto, during a respective transportation stepping movement thereof. That does not increase the degree of complication of the apparatus to a major extent as the transportation devices have to be provided in any case. Arranging the UV-radiating device in such a way that it can be moved with the object to be transported amounts to arranging the drying device not stationarily but movably. The structural measures required for that purpose do not involve significant increases in expenditure. That is the case in particular when the drive for the drying station can be derived from a drive which already exists in the apparatus.

Figure 5:
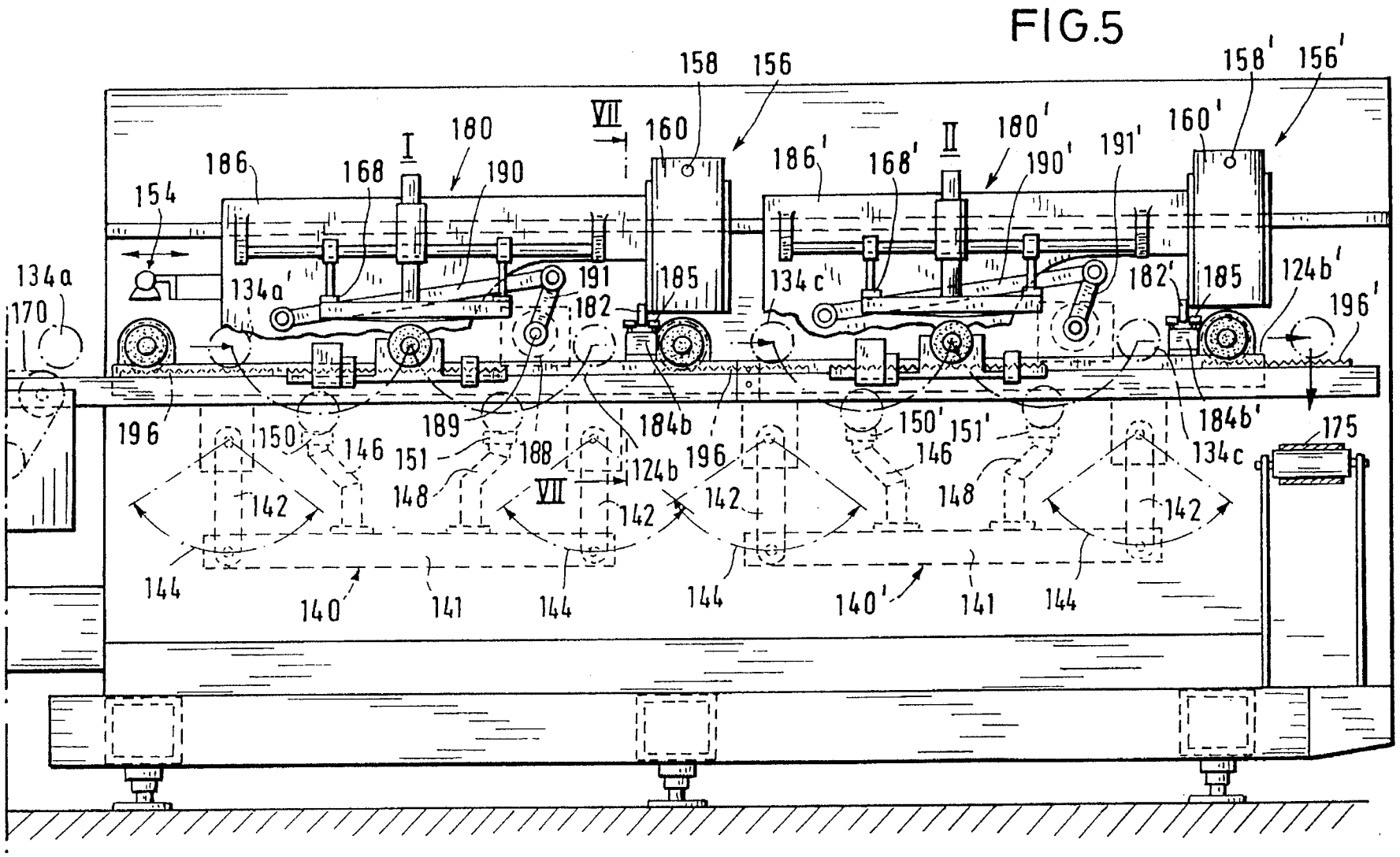
FIG. 5 is a side view of a second embodiment in the working phase corresponding to that in FIG. 2.
Figure 6:
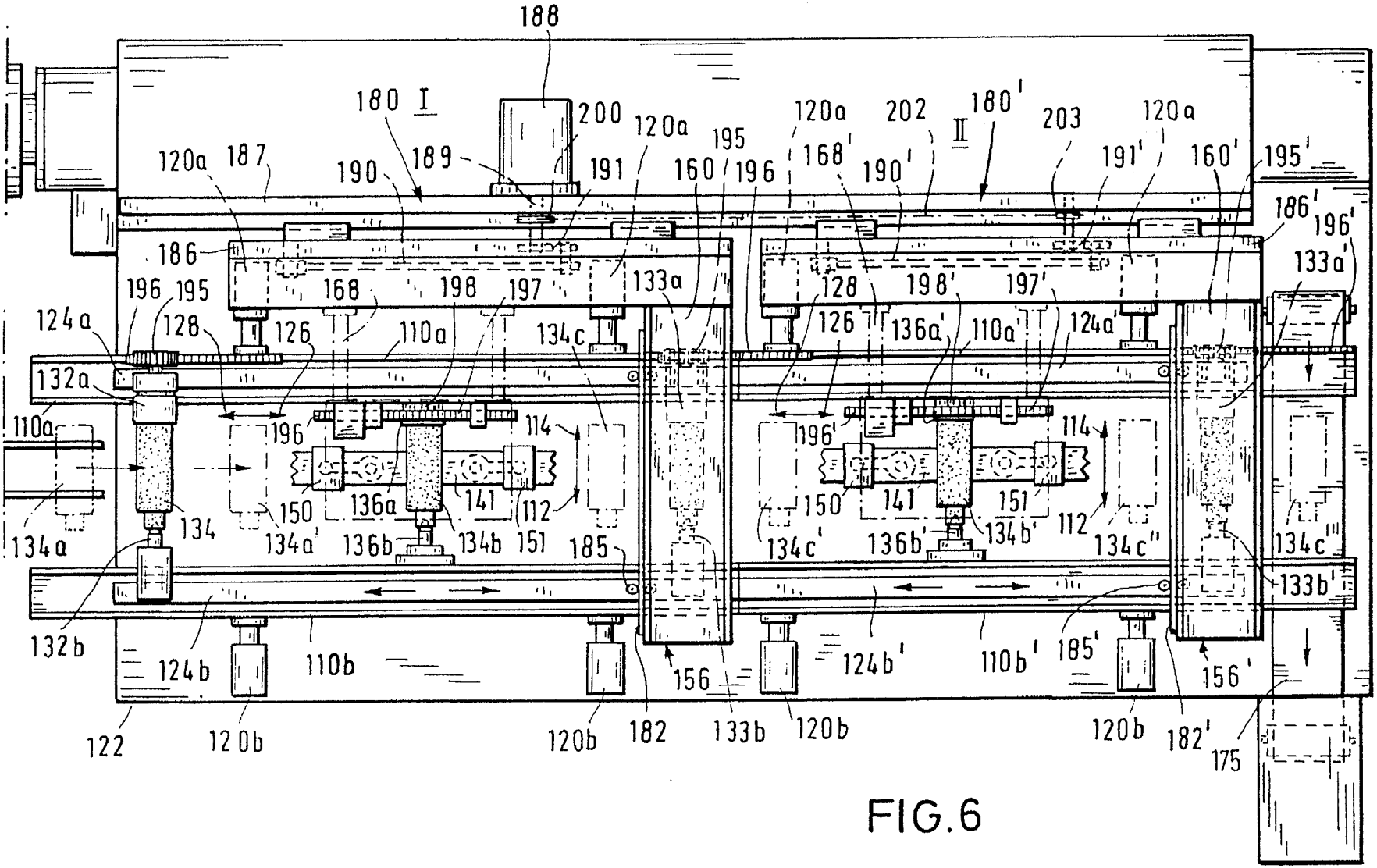
FIG. 6 is a plan view of FIG. 5.

Referring now to FIGS. 5 and 6, shown therein is a further embodiment of the invention comprising two printing stations 180, 180' which are disposed in succession in the direction of transportation movement of the objects, a UV-radiating device being disposed downstream of each printing station. Apart from some modifications and the conveyor means which convey the objects to be printed to the printing machine and the objects after printing away from the printing machine, the apparatus shown in FIGS. 5 and 6 essentially constitutes a doubling of the embodiment illustrated in FIGS. 1 through 4 so that corresponding components are identified in FIGS. 5 and 6 by the same reference numerals but increased in each case by 100. In principle the printing machine shown in FIGS. 5 and 6 comprises first and second modules I and II which are assembled to form an operative unit and which are arranged in succession in the transportation direction 126 of the objects.

The object 134 is transported through the module I by the holder carriers 124*a* and 124*b* and the transportation device 140 of the module I in the manner already described hereinbefore in connection with the embodiment shown in FIGS. 1 through 4, until the object 134 has reached the position at 134*c'* in which it is firstly still carried by the two holder members 133*a* and 133*b*. At the latest after reaching that position, the transportation device 140' of the second module II which has the second printing station 180' and the second drying device 156' associated therewith is pivoted into the left-hand limit position in the direction indicated by the arrow 144', which corresponds to the limit position shown in FIG. 3. In that limit position the mounting 150' bears at the underside against the object which is disposed in the position 134*c'* so that the latter is carried by the mounting 150', after the two carriers 124*a* and 124*b*, in the form of rails, have been moved apart in the directions indicated by the arrows 12 and 14 respectively and have released the object. In the subsequent movement of the transportation device 140' in the direction indicated by the arrow 144' into the right-hand limit position which corresponds to the position of the transportation device 40 in FIG. 1, the object which is carried by the mounting 150' and which is provided with a first print in the printing station 180 is transported into the second printing station 180' between the two holding members 136*a'*, 136*b'* which are disposed there and which are carried by the rails 110*a* and 110*b* respectively. At that time the two rails 110*a* and 110*b* are still positioned in such a way that they are at their greatest spacing from each other.

The transportation device: 140' is also provided with a second mounting 151' which, at the moment at which the mounting 150' is disposed in the position indicated at 134*c'*, takes up the position corresponding to that shown in FIG. 3, that is to say it is disposed below the object in the printing station 180' and bears against the object so that, when the two holding rails 124*a'* and 124*b'* are moved away from each other, that object, which has been printed upon, is released by the two holding members 136*a'* and 136*b'* and is carried by the mounting 151' and thus, in the above-mentioned pivotal movement of the transportation device 140' towards the right, that is to say into a position corresponding to that shown in FIG. 3, is transported into the starting position for the subsequent drying operation. That position is identified by reference 134*c''* in FIGS. 5 and 6. As soon as the transportation device 140' has reached its right-hand limit position corresponding to that shown in FIG. 1, the two carriers 124*a'*, 124*b'* which are desirably moved synchronously with the two carriers 124*a*, 124*b* in both directions are moved into the positions in which they are at the smallest spacing from each other so that the holding members 136*a'*, 136*b'* and 133*a'*, 133*b'* respectively accommodate the object which is disposed in the printing station 180' or the starting position 134*c''* for the second drying operation. In the subsequent displacement of the two carriers or rails 124*a'*, 124*b'*, in the direction indicated by the arrow 126, the object is transported out of the position 134*c''* into the limit position 134*c'''*, more specifically synchronously with the drying device 156'. In the course of that movement, the printing ink applied to the object in the second printing station 180' is dried. When the object is in the position 134*c'''*, the two carriers 124*a'*, 124*b'* which are carried by the U-shaped rails 110*a'*, 110*b'* are moved away from each other again, in which case the object which is in the position 134*c'''* drops on to the conveyor belt 175 disposed therebeneath, and is transported away. The object which in the meantime has been printed upon in the printing station 180' and which is still disposed therein is taken over by the mounting 151' which at that time assumes a position corresponding to that shown in FIG. 3, in which the mounting 150' receives the object disposed in the station 134*c*, which had already been printed in the station 180 and thereafter dried. The transportation devices 140, 140' are moved synchronously.

It will be noted that in the embodiment shown in FIGS. 5 and 6 the carriers 124*a'*, 124*b'* associated with the second printing station 180' are only provided with the; pair of holding members 133*a'*, 133*b'*. There is no need here for a pair of holding members corresponding to the pair of holding members 132*a*, 132*b* of the carriers 124*a*, 124*b*, as the second printing station 180' is not preceded by a special treatment station and in particular a flame treatment station corresponding to the station 154. On the contrary, as described, the object which is disposed at the end of the first treatment session in the module I in the station 134*c'* is transported directly into the printing station 180' by the transportation device 140.

Figure 7:
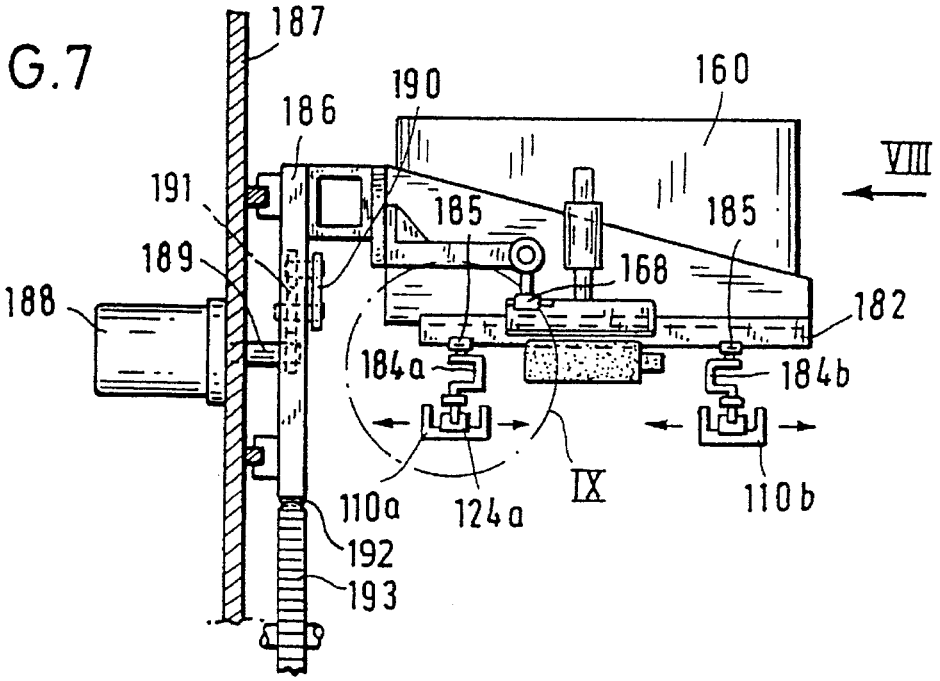
FIG. 7 is a view in section along line VII—VII in FIG. 5.
Figure 8:
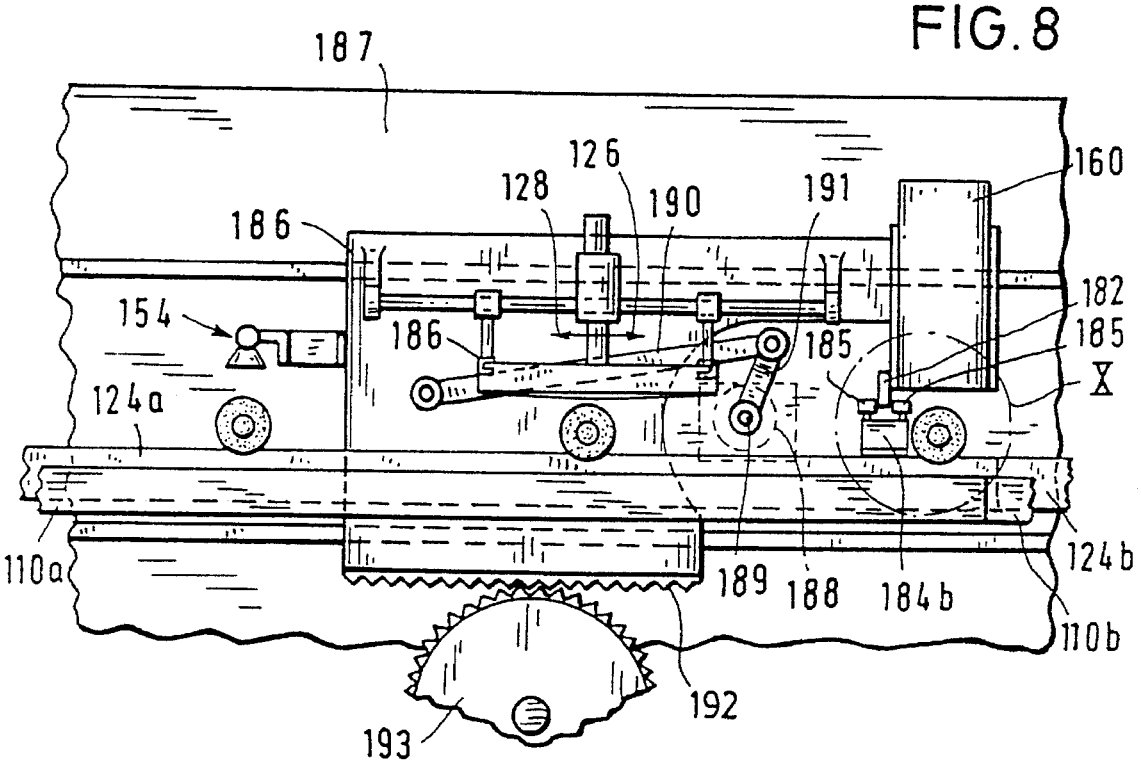
FIG. 8 is a view of parts of the screen printing machine approximately in the direction of the arrow VIII in FIG. 7.
Figure 9:
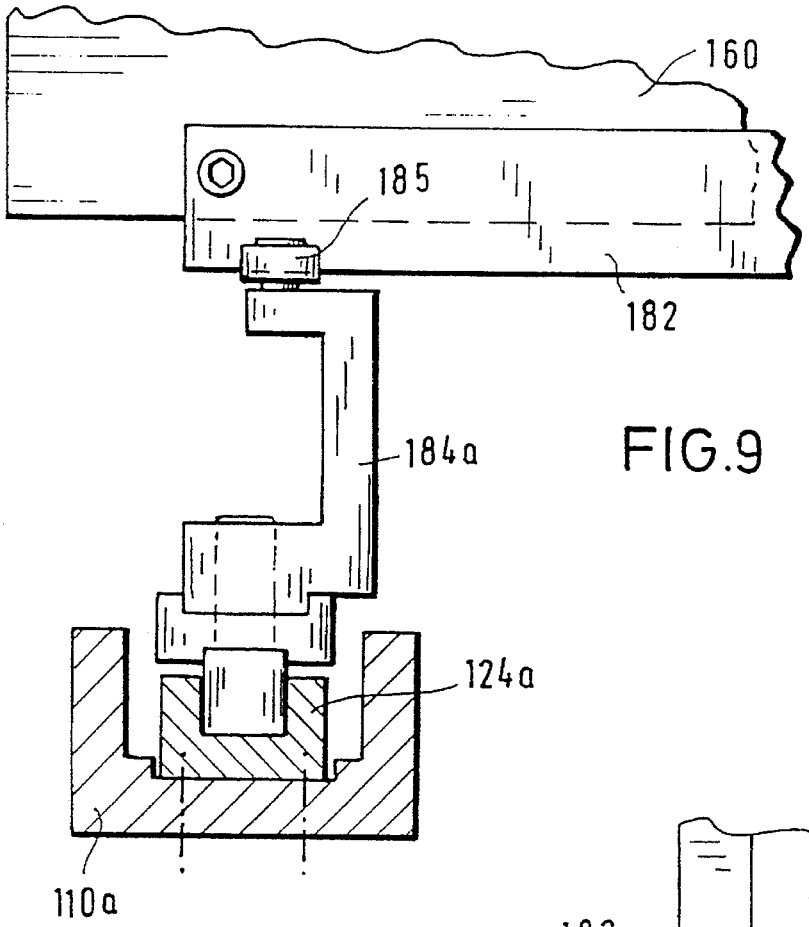
FIG. 9 shows the portion IX in FIG. 7 on a larger scale.
Figure 10:
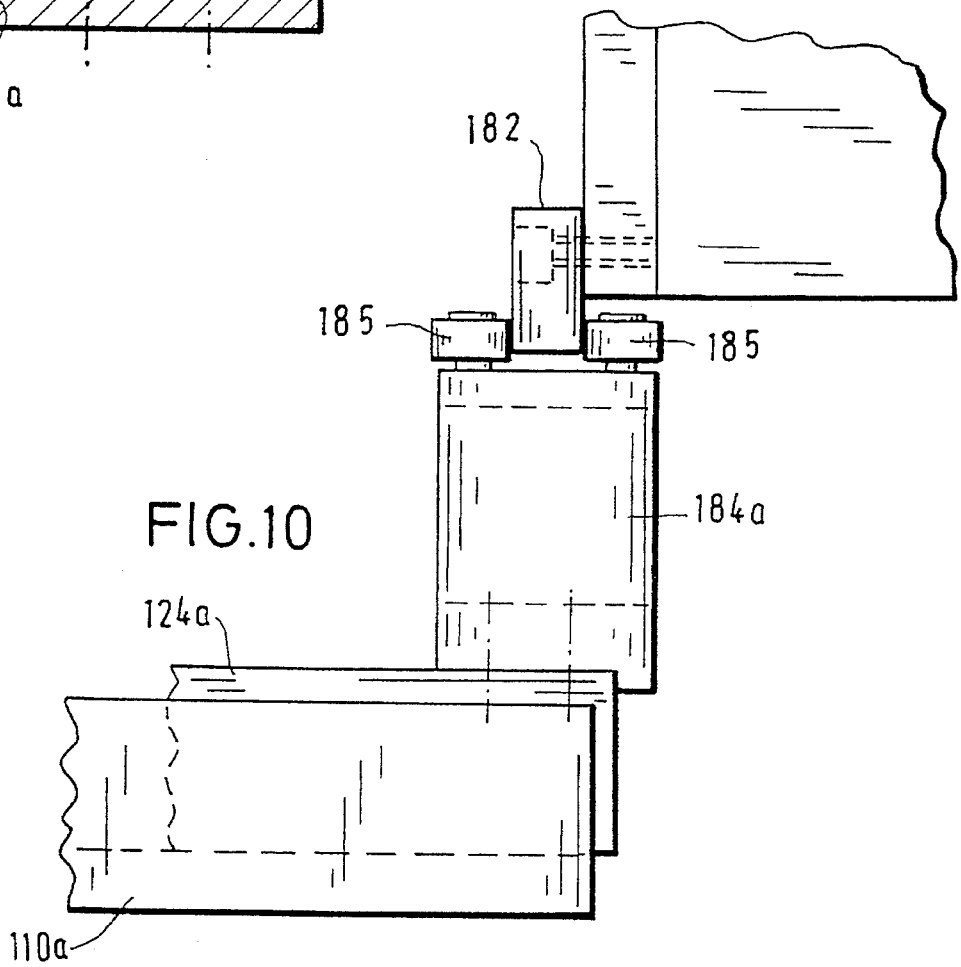
FIG. 10 shows the portion X in FIG. 8 on a larger scale.

In order to provide for synchronous movement between the printed object on the one hand and the drying device on the other hand, in a simple manner, the reciprocating movements of the two pairs of carriers 124*a*, 124*b* and 124*a'*, 124*b'* respectively are produced by the drying devices 156 and 156' respectively. For that purpose each of the two housings 160, 160', within which the UV-radiating devices 158 and 158' respectively are arranged, is provided with a bar 182 and 182' respectively. The bars extend substantially transversely relative to the longitudinal direction of the carriers 124*a*, 124*b* and 124*a'*, 124*b'* respectively and each serve for mounting and guiding two entrainment members of which the drawing shows the entrainment members 184a, 184b associated with the housing 160 (see FIG. 7), and the entrainment member 184*b'* (see FIG. 5). The latter is associated with the housing 160'. At its end towards the respectively associated housing 160 and 160', each of the entrainment members is provided with two guide rollers 185, each of which is disposed at a side of the respective guide bar 182 and 182' respectively. At its end remote from the respective housing 160, 160', each entrainment member 184*a*, 184*b*, 184*a'*, 184*b'* is fixedly connected to the respectively associated carrier 124*a*, 124*b*; 124*a'*, 124*b'*. The consequence of that arrangement is that the reciprocating movements of the two housings 160, 160' are transmitted directly to the respectively associated carriers 124*a*, 124*b*, 124*a'*, 124*b'*. The fact that the carriers are coupled to the housings directly and practically rigidly in the directions of the reciprocating movements guarantees absolute synchronism in regard to the reciprocating movements in the directions of the arrows 126, 128 of the respective UV-radiating device and the object disposed in the region thereof, as the object is carried by the holding members 133*a*, 133*b* and 133*a'*, 133*b'* respectively, which in turn are fixed to the carriers 124*a*, 124*b*, 124*a'*, 124*b'* respectively. As the positive connection between the entrainment members 184*a*, 184*b* and 184*a'*, 184*b'* and the respective guide bar 182, 182' is by way of the rollers 185, it is also possible for the entrainment members to be displaced perpendicularly to the longitudinal extent of the carriers 124*a*, 124*b* and 124*a'*, 124*b'* respectively when the latter are moved for engaging or releasing the objects, in the direction indicated by the respective arrows 112 and 114.

The housings 160 and 160' with the UV-radiating devices are respectively carried by a carriage 186 and 186' which is guided on the machine frame structure 187 displaceably in the directions indicated by the respective arrows 126 and 128. The drive is produced by way of a motor 188 whose shaft 189 is provided with a conventional crank transmission assembly 190, 191 for converting the rotary movement of the shaft 189 into reciprocating movements of the carriage 186 to which the arm 190 of the crank transmission assembly 190 and 191 is connected. The drive for the carriage 186' is also produced by way of a crank transmission assembly 190, 191' which is also connected to the motor 188 by way of a gear 200 arranged on the shaft 189', a chain 202 and a gear 203. As both carriages 186, 186' are driven by the same motor 188, that guarantees synchronous movements of the two carriages.

The support carriers 168 and 168' for the screen printing stencils are also mounted on the carriages 186 and 186' respectively.

The drive for the two transportation devices 140 and 140' is also derived from the carriages 186 and 186'. For that purpose each carriage 186, 186' is provided at its underside with a toothed rack 192 meshing with a respective toothed segment 193 from which the drive is taken off for the respective transportation devices 140 and 140' respectively, so that here too the arrangement guarantees synchronism of the movements involved.

In all treatment stations the arrangement can be such that during the treatment the objects are involved in a rotary movement about their longitudinal axis or am axis parallel thereto. Where the objects are transported at the same time during the treatment operation, that rotary movement can be produced in a simple fashion by the holding members for the objects being mounted rotatably on the carriers 124*a*, 124*b* and 124*a'*, 124*b'* and provided with a gear 195 meshing with a stationarily disposed toothed rack 196 and 196' respectively. During the movement of the respective holding member a rotary movement is transmitted thereto and to the object carried by same. The toothed racks 197 and 197' are longitudinally displaceably arranged in the printing stations 180, 180' in which the holding members 136*a*, 136*b* and 136*a'*, 136*b'* are stationarily arranged. Each toothed rack 197, 197' meshes with a respective gear 198, 198' connected to the holding member 136*a* and 136*a'* respectively. In all cases it is sufficient for only a respective one of the two holding members which co-operate in pairs to be driven by way of a respective toothed rack and gear. The other holding member which is also rotatably supported is then entrained by the object.

It will be appreciated that the connection between the housings of the UV-radiating devices on the one hand and the holding carriers on the other hand, as shown in FIGS. 5 through 10, may also be used in the embodiment described above with reference to FIGS. 1 through 4. On the other hand, the direct connection between the screen printing stencil and the UV-radiating devices by way of the coupling rods 66 of the embodiment shown in FIGS. 1 through 4 may also be used in a machine having two or more printing stations. In any case a direct or indirect connection between the screen printing stencil on the one hand and the associated UV-radiating device on the other hand is also desirable for the reason that this in a single fashion maintains a constant spacing between the screen printing stencil and the UV-radiating device under all circumstances, in which respect the spacing can be such that the screen printing stencil and thus the printing ink thereon remain outside the emission region of the UV-radiating device. That prevents unintentional drying of the ink when still on the screen printing stencil, under the effect of UV-rays of the downstream-disposed UV-radiating device. Accordingly that kind of arrangement affords the possibility of maintaining in every case the required spacing which is to be as small as possible in order to avoid the UV-rays acting on the printing ink on the screen printing stencil.

The above described advantages are achieved when using the invention by simple means which do not cause any substantial complication in the printing machine. That applies even when, as in both of the embodiments described above with reference-to the drawings, there are two holder carrier for the holding members, as is also described in U.S. Pat. No 4,048,914.

It will be fully appreciated that modifications may be made without departing from the spirit and scope of the invention. Thus there is no need for the apparatus to be of a modular structure, as shown in FIGS. 5 and 6, by two or if necessary more apparatuses corresponding to the embodiment shown in FIGS. 1 through 4 being connected in succession. It is also possible for the apparatus, provided with a plurality of printing stations, to be formed as a unit. It is also possible to envisage intermediate structures, for example such that the modular structure is retained, but there are provided holder carriers 124*a*, 124*b* which extend over the entire apparatus, that is to say all printing stations and associated items of equipment and the movement of which is also taken off at least one of the housings 160, 160'. In general terms however having regard to the masses to be moved it will also be desirable in that respect to provide for a coupling between all housings 160, 160' on the one hand and the two carriers 124*a*, 124*b* on the other hand.

The objects to be printed upon when using the method and apparatus in accordance with the invention are not continuous material in web form but individual objects such as bottles, glasses or other articles which are possibly rotated or pivoted during the printing operation and possibly also during the drying operation. However the individual objects may also involve objects of a flat or planar configuration which do not need to be rotated or pivoted during the printing operation and/or the drying operation.

The objects are transported individually, in which respect the extent of an object in the direction of transportation movement is in many cases shorter than the distance by which the UV-radiating device is moved during the drying stepping movement.

It will be noted that a number of advantages derive from the procedure according to the invention of effecting the operation of drying the printing ink applied in a preceding printing station during a transportation stepping movement which is in any case required. On the one hand, a portion of the working cycle which is in any case necessary from the point of view of operating procedure and apparatus structure and which serves for transportation of the object is additionally put to use for performing a treatment operation so that in general it is possible to save on either a transportation stepping movement or a treatment station. In situations in which, in a working cycle, the proportion of the time which is required for the transportation movement is greater than the proportion of the time during which the objects are disposed in the printing station, the treatment operation which involves the longest duration, namely the step of drying the printing by means of UV-rays, can also be associated with the pert of the working cycle which involves the longer period of time.

It will also be noted that the invention can also be used more particularly when a plurality of partial print images are successively applied to an object, and supplement each other to make up an overall print image. That is the case for example in composite multi-color printing. Here, after each partial print image has been applied, a drying operation has to be carried out so that a further partial print image can then be immediately applied. In that case, the drying operation could be carried out during transportation of the object from the one printing station to the next printing station.

It will be appreciated that the above-described method and apparatus according to the present invention have only been set forth by way of example and illustration of the principles thereof and that various modifications and alterations may be made therein without thereby departing from the spirit and scope of the invention.

I claim:

1. Apparatus for priming on an object and drying the object with a UV-radiating device comprising:

(a) at least one printing station including at least one screen printing stencil and a doctor cooperating therewith for priming images on an object in a printing operation;

(b) at least one transportation device for assisting in transporting the object through at least a portion of the apparatus;

(c) at least one UV-radiating device for delivering UV-rays in a region to an object for drying in a drying operation at least one prim image applied thereto by the screen priming stencil and the doctor;

(d) means disposing the UV-radiating device movably so that the UV-radiating device is movable in a direction of movement of the printed object during a transportation movement of the printed object, and so that during the transportation movement of the printed object at least the part of the object which bears the applied print image is passed in the region of the UV-rays;

(e) a first holding means for carrying the UV-radiating device;

(f) a third holding means comprising holders for carrying the screen printing stencil; and (g) means operatively connecting the first holding means to the third holding means, thereby causing the first and third holding means to move in unison.

2. Apparatus for priming on an object and drying the object with a UV-radiating device comprising;

(a) at least one priming station including at least one screen printing stencil and a doctor cooperating therewith for printing images on an object in a printing operation;

(b) at least one transportation device for assisting in transporting the object through at least a portion of the apparatus;

(c) at least one UV-radiating device for delivering UV-rays in a region to an object for drying in a drying operation at least one print image applied thereto by the screen printing stencil and the doctor;

(d) means disposing the UV-radiating device movably so that the UV-radiating device is movable in a direction of movement of the printed object during a transportation movement of the printed object, and so that during the transportation movement of the printed object at least the part of the object which bears the applied print image is passed in the region of the UV-rays;

(e) a first holding means for carrying the UV-radiating device;

(f) a second holding means comprising holders for carrying the object at least during the drying operation; and (g) a third holding means for carrying the screen printing stencil; and (h) means operatively connecting the first holding means, the second holding means, and third holding, means thereby causing the first, second and third holding means to move in unison.

3. Apparatus as set forth in claim 1 further comprising a second holding means comprising holders for carrying the object at least during the drying operation.

4. Apparatus as set forth in claim 3 wherein the operative connection means connects the second holding means to the first holding means and the third holding means, thereby causing the first, second, and third holding means to move in unison.

5. Apparatus as set forth in one of claims 2 and 4 wherein the operative connection means of the UV-radiating device to the holders for carrying the object is a physical coupling, thereby ensuring that the object undergoing a drying treatment is moved synchronously with the UV-radiation device.

6. Apparatus as set forth in claims 2 or 3 wherein the holders for engaging the object during the drying operation include means for allowing the object to be rotated about its longitudinal axis.

7. Apparatus as set forth in claims 1 or 2 wherein the means for disposing the UV radiating device further comprises means for moving the UV-radiating device synchronously with the printed object during the drying operation.

8. Apparatus as set forth in one of claims 1 and 2 wherein the operative connection means of the UV-radiating device to the screen printing stencil is a physical coupling, thereby ensuring that the drying operation of an object already primed is synchronized with the printing operation of an object undergoing printing.

9. Apparatus as set forth in claims 1 or 2 wherein the means for disposing the UV radiating device further comprises means for moving the UV-radiating device in an opposite direction back into a starting position after reaching the position at the end of its movement, the end position being associated with the end of the drying operation.

10. Apparatus as set forth in claims 1 or 2 wherein the UV-radiating device includes a housing having an opening facing the object, wherein the UV-rays leave the housing through the opening.

11. Apparatus as set forth in claims 1 or 2 further comprising a second transportation device for moving the object from its position at the end of the priming operation into a starting position for the transportation movement, the object being exposed to the UV-rays during the transportation movement.

12. Apparatus as set forth in claim 11 wherein the second transportation device further comprises means to transport the object into the printing station.

13. Apparatus as set forth in one of claims 1 or 2 further comprising at least a second printing station through which the object passes in succession and arranged downstream of the at least one printing station in the direction of transportation movement, the at least one printing station having the at least one UV-radiating device for drying the respectively previously applied print image.

14. A method of priming on an object using at least one screen printing stencil and a doctor cooperating therewith and drying the object with at least one UV-radiating device, the UV-radiating device and the object disposed in first and second holding means, respectively, which are operatively connected together so that they move in unison, the drying being performed while the object passes through a drying area with the assistance of a transportation device, the method comprising the steps of (a) applying a printed image to the object in at least one printing station containing the screen printing stencil and cooperating doctor;

(b) delivering the printed object to a drying station containing the UV-radiating device; and (c) drying the image applied on the printed object by passing at least a part of the object in a region of UV-rays produced by the UV-radiating device during a transportation movement of the printed object through a treatment area, while also simultaneously moving a preceding object through the printing station, the operative connection of the first and second holding means allowing the UV-radiating device and the object to move in unison to simultaneously dry the printed object while the preceding object is printed.

15. A method as set forth in claim 14 further comprising the step of (d) moving the UV-radiating device in an opposite direction back into a starting position after reaching the position at the end of its movement, the end position being associated with the end of the drying operation.

16. A method as set forth in claim 14 wherein during the drying step (c), at least one holder having a receiving means for mounting the object thereon holds the object.

17. A method as set forth in claim 14 wherein during the drying step (c), holders engage the object and allow the object to be rotated about its longitudinal axis.

18. A method as set forth in claim 14 whereby during step (c), the object performs a rotary movement about its longitudinal axis.

19. A method as set forth in claim 14 wherein, during step (c), the object performs a rotary movement about an axis which is at least substantially parallel to the longitudinal axis of the object.

20. A method as set forth in claim 14 wherein, during step (c), the object performs a linear transportation movement.

21. A method as set forth in claim 14 wherein at least two print images are applied to the object in succession and after at least one of the printing operations the object is subjected to treatment by UV-rays during a transportation movement using the at least one UV-radiating device which during drying is moved with the object in the direction of movement thereof such that the object is exposed to the UV-rays.

22. A method of printing on an object comprising the steps of:

providing at least one screen printing stencil and a doctor cooperating therewith;

providing at least one UV-radiating device;

disposing the UV-radiating device and the screen printing stencil in first and third holding means, respectively;

operatively connecting the first and third holding means so that they move in unison;

applying a printed image to the object in at least one printing station containing the screen priming stencil and cooperating doctor;

delivering the primed object to a drying station containing the UV-radiating device;

drying the image applied on the printed object by passing at least a part of the object through a region of UV-rays produced by the UV-radiating device during a transportation movement of the printed object through a treatment area; and moving simultaneously with the transportation movement of the printed object a preceding object through the printing station, the operative connection of the first and third holding means causing the UV-radiating device to move in unison with the screen printing stencil to simultaneously dry the primed object while the preceding object is printed.

23. A method as set forth in claim 22 wherein the object is disposed in a second holding means which is operatively connected to the first holding means and the third holding means, thereby causing the first, second and third holding means to move in unison and allowing the UV-radiating device and the object to move in unison to simultaneously dry the primed object while the preceding object is primed.

* * * * *